United States Patent [19]

Chien et al.

[11] Patent Number: 4,656,446

[45] Date of Patent: Apr. 7, 1987

[54] CURRENT LIMITING CIRCUIT BREAKER WITH SERIES DOUBLE BREAK CONTACT SYSTEM PER POLE

[75] Inventors: Yun-Ko N. Chien, Murrysville; John A. Wafer, Brighton Twp., Beaver County, both of Pa.

[73] Assignee: Westinghouse Electric Corp., Pittsburgh, Pa.

[21] Appl. No.: 809,704

[22] Filed: Dec. 17, 1985

[51] Int. Cl.[4] ..... H01H 9/34

[52] U.S. Cl. ..... 335/201; 200/144 R

[58] Field of Search ..... 335/201; 200/144 R

[56] References Cited

U.S. PATENT DOCUMENTS 3,790,911 2/1974 Kick et al. ..... 335/201

4,048,600 9/1977 Dietrich ..... 335/201 X 4,408,173 10/1983 Adlerteg et al. ..... 335/6 X

*Primary Examiner*—Arthur T. Grimley

*Assistant Examiner*—Jane K. Lau

*Attorney, Agent, or Firm*—L. P. Johns

[57] ABSTRACT

A current limiting circuit breaker characterized by pairs of stationary and movable contacts with the movable contacts connected in series; an arc-extinguishing chamber including arc guide rails associated with each pair of contacts and in side-by-side relationship; manually operable means for opening and closing the circuit through the contacts; current-limiting electromagnetic means for opening the contact; and linkage means between the manually operable and electromagnetic means for enabling opening of the contacts by the electromagnetic means without tripping the manually operable means.

8 Claims, 8 Drawing Figures

CURRENT LIMITING CIRCUIT BREAKER WITH SERIES DOUBLE BREAK CONTACT SYSTEM PER POLE

BACKGROUND OF THE INVENTION

1. Field of the Invention

This invention relates to circuit breakers, and more particularly, to current limiting circuit breakers having a series double break contact system with at least two arc extinguishing chambers for each pole.

2. Description of the Prior Art

Recent trends in electrical distribution systems have involved increases in size and capacity to meet expanding demands for electrical service. For example, utilities have employed lower-impedance transformers to reduce power losses, regulation problems, and cost. Current-limiting circuit breakers are available with ratings up to 400A and interrupting capacities up to 200,000A.

To prevent such high available fault currents from damaging electrical distribution systems, protective devices limiting the prospective let-through currents are required. Fuses and, more recently, current-limiting circuit breakers have been used successfully to limit these high currents. They can reduce to tolerable levels both the peak fault currents ($I_p$) and the thermal energy ($I^2t$) that reach downstream equipment. Mechanical and magnetic forces that can destroy equipment are proportional to the square of the peak currents $(I_p)^2$, and thermal damage is proportional to the energy let-through.

SUMMARY OF THE INVENTION

In accordance with this invention a current limiting circuit breaker is provided that comprises a circuit breaker structure within an insulating housing and having stationary contact means and movable contact means, arc quenching means including at least two separate arc-quenching chambers side-by-side within the housing and having a line side arc guide rail and a load side arc guide rail, the stationary contact means including at least a pair of spaced stationary contacts, one contact on the line side and adjacent to one of the chambers and the other contact being on the load side and adjacent to the other of the chambers, the movable contact means including at least a pair of corresponding movable contacts connected in series and movable simultaneously between open and closed circuit conditions, first contact means for actuating the movable contacts between open and closed circuit conditions, second means for moving the movable contacts and including current limiting electromagnetic means responsive to an overcurrent circuit condition, and each movable contact being an elongated arm having one end pivotally mounted on a corresponding arc guide rail and another end in response to operation of one of the first and second means, so as to cause arcs forming between the corresponding stationary and movable contacts to move from the contacts and into the corresponding arc quenching chambers.

The advantage of the device of this invention is that it provides two arcs in series which provide higher arc voltage, resulting in better arc extinguishing characteristics and therefore better current limiting effect.

DESCRIPTION OF THE PREFERRED EMBODIMENTS

Figure 1:
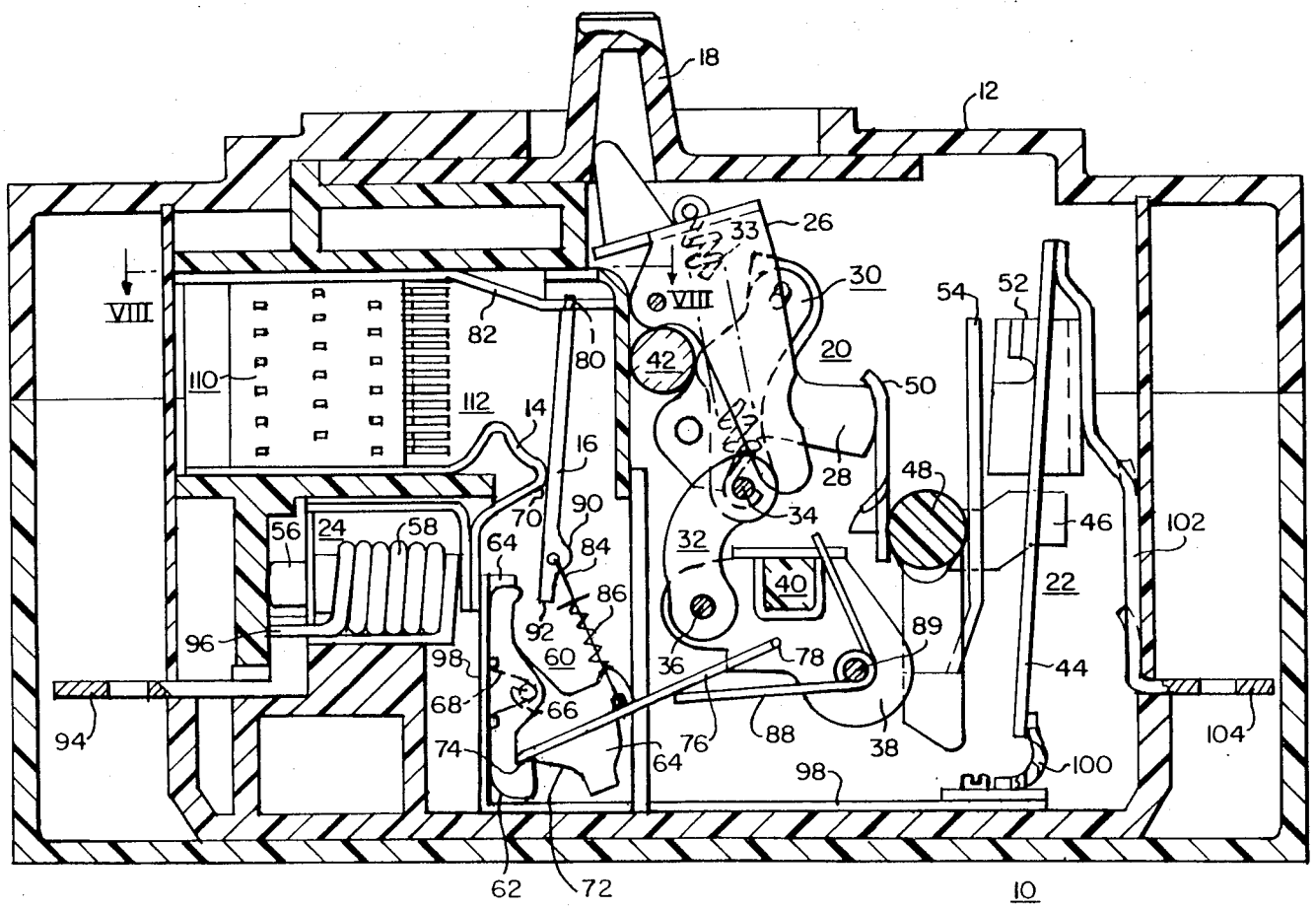
FIG. 1 is a vertical sectional view through a circuit breaker according to the invention with the cover forming one of the two main walls of the housing removed and with contacts shown in the closed circuit position.
Figure 7:
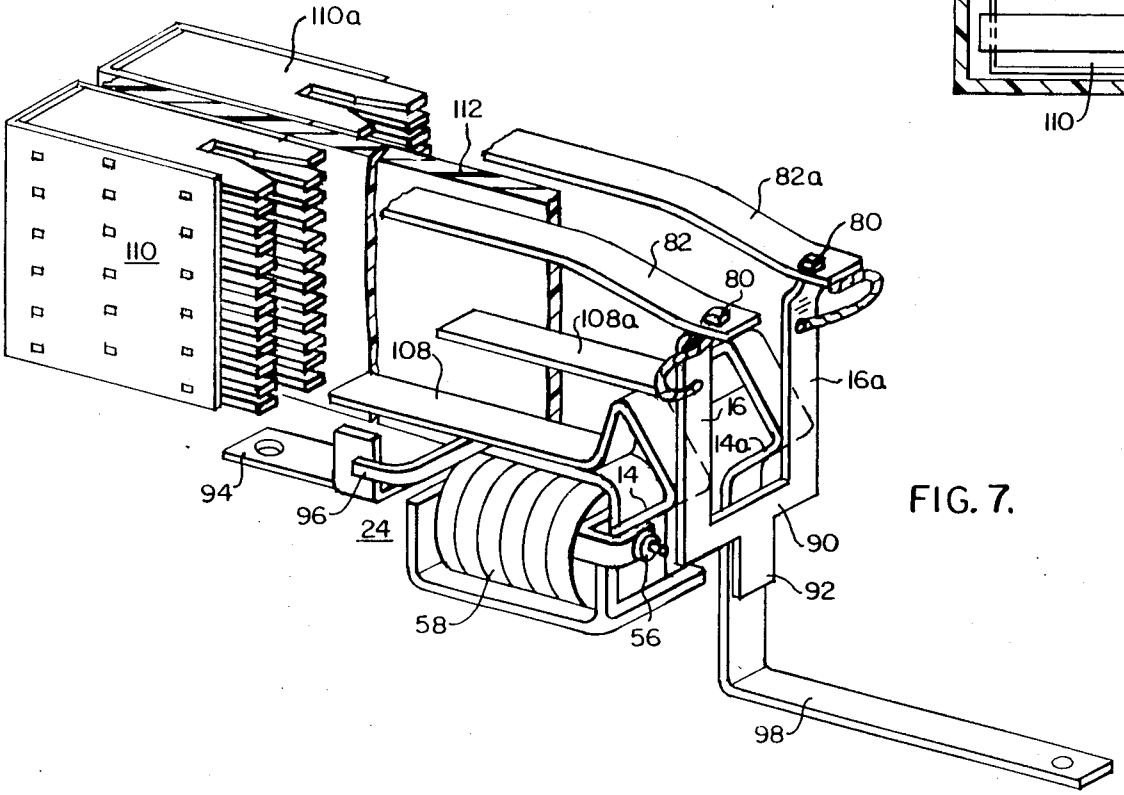
FIG. 7 is an isometric exploded view of the contacts and arc chutes of this invention.

In the drawings a current limiting circuit breaker is generally indicated at 10 and it comprises an insulating housing or molded case 12, and separable contacts including stationary contacts 14, 14a and movable contacts 16, 16a (FIGS. 1 and 7). The contact means are releasable either manually, electromagnetically, or by thermo-electric means. The manual means include a handle 18 for actuating an operating mechanism 20 which is also releasable to a tripped position for opening the contacts by automatic trip means, such as a thermo-electric device 22. Other automatic trip means may include an adjustable magnetic trip or an electronic trip unit. The contacts 14, 16 are also releasable to open positions by an electromagnetic release means 24.

The operating mechanism 20 is spring-loaded and resembles similar mechanisms of traditional technology, such as disclosed in U.S. Pat. No. 4,030,060. Generally, the mechanism 20 is an over-center toggle device which includes a metal yoke 26, a cradle or releasable arm 28, a pair of toggle links 30, 32 which are pivoted together at 34, and toggle springs 33 extending from the pivot 34 to the upper end of the yoke 26. The lower end of the toggle link 32 is pivotally connected at 36 to a connector 38 on a tie bar 40. A stop pin 42 arrests counterclockwise movement of the yoke 26 when the handle 18 is moved to the ON position with the contacts 14, 16 closed (FIG. 1).

The thermo-electric device 22 includes a bimetal 44, a lever 46 pivoted on a pin 48, and a latch 50. The device 22 also includes a magnetic trip device having a magnet 52, an armature 54 which are associated with the bimetal 44 for rotating the lever 46 and for moving the latch 50 from a latch position in conjunction with the releasable arm 28.

Any short circuit that trips a lever means 60 may or may not trip the device 22; it depends upon a predetermined setting of the threshold value for tripping the latter. Suffice it to say, the lever means 60 is quicker than the device 22.

Figure 2:
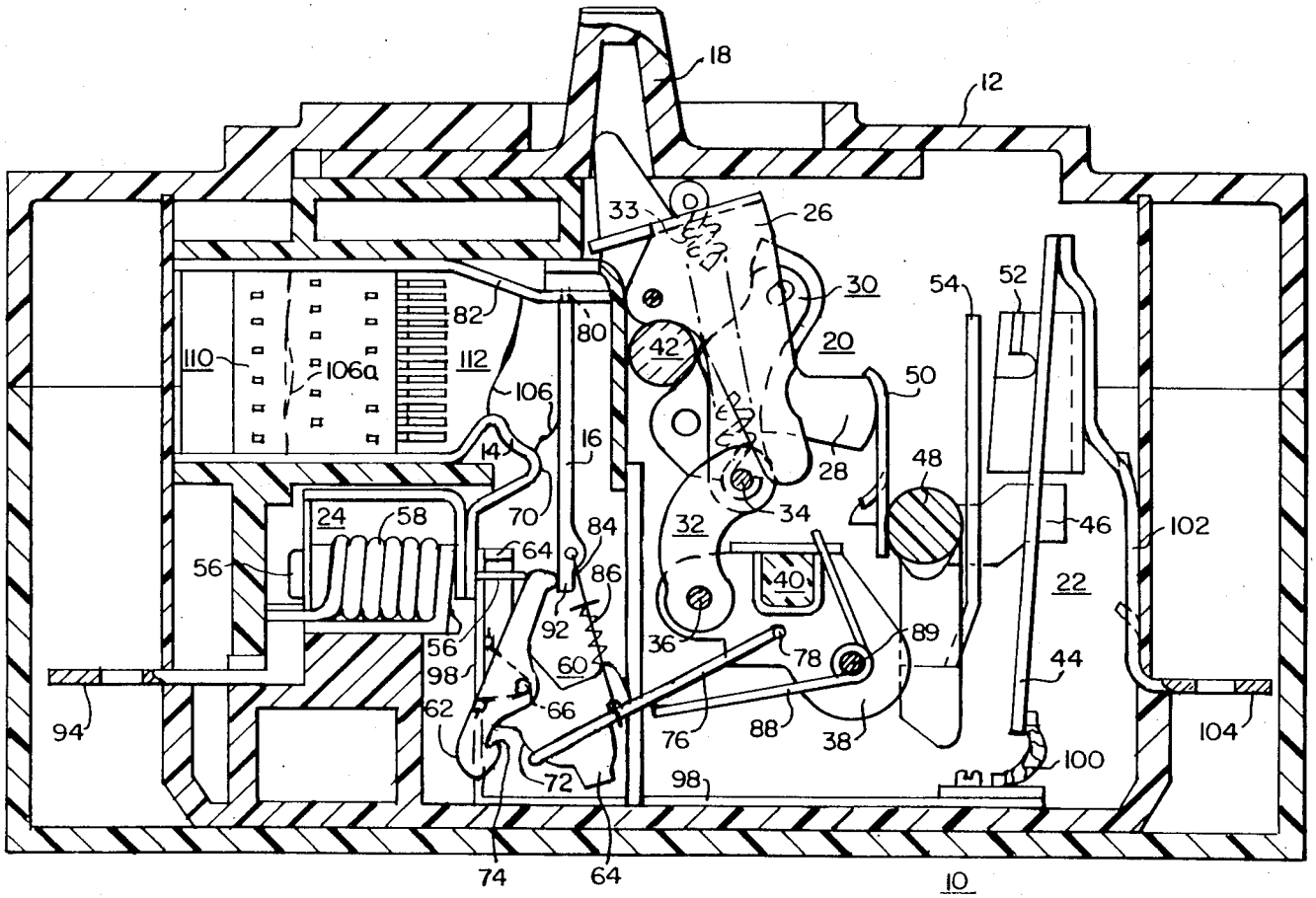
FIG. 2 is a sectional view showing the contacts in the initial trip and open circuit position.

The electromagnetic release means 24 operates in response to a short circuit in the power supply as compared with the thermo-electric device 22 which includes the bimetal strip 44 in response to an overload in the circuit. When a short circuit occurs, an armature 56, under the influence of the energizing coil 58, is actuated to the right moving the movable contacts 16 from the closed position (FIG. 1) to the open position (FIG. 2).

Figure 3:
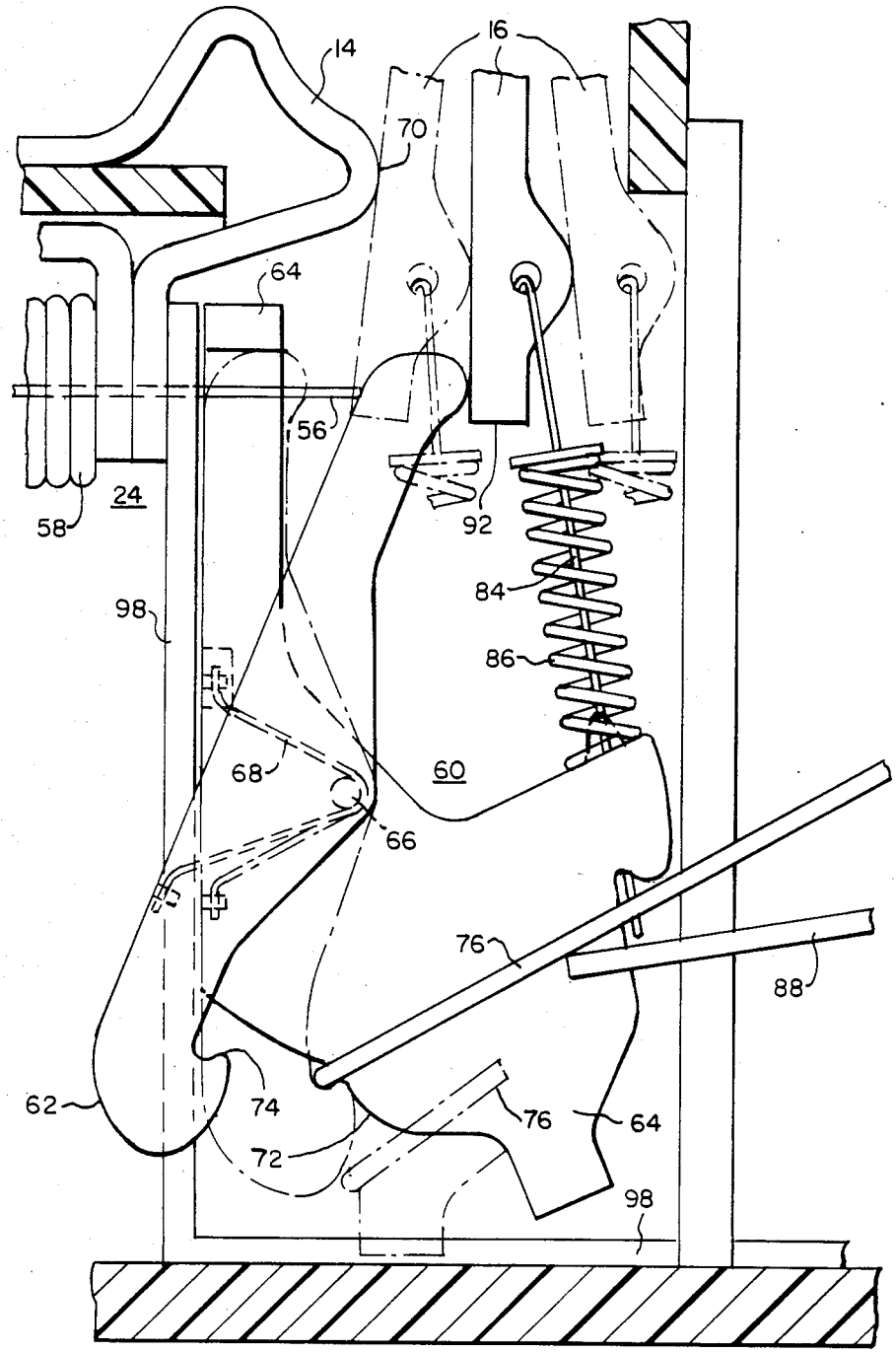
FIG. 3 is an enlarged sectional view of the lever means.

Lever means 60 (FIG. 3) includes trip lever 62 and a tilt lever or kicker 64 provided between the electromagnetic release means 24 and the movable contacts 16. Both levers 62, 64 ar mounted on a pivot pin 66 and a wire spring 68 around the pin maintains the trip lever 62 in alignment with the tilt lever 64 (FIG. 1). More particularly, the trip lever 62 being mounted on the pivot pin 66 is in side-by-side relation with the tilt lever 64 and is aligned with the armature 56 (FIG. 2), so that when the armature 56 is moved to the right the trip lever moves against the lower end of the movable contact 16 to move it out of engagement with a knee 70 of the stationary contact 14, thereby opening the circuit.

When the contacts are closed (FIG. 3), the lower end of the lever 62 is disposed against an inclined surface 72 of the tilt lever 64. As shown more particularly in FIG. 2 the trip lever 62 includes a notch 74 which, when disposed against the inclined surface 72 (FIG. 1), provides an aperture in which one end of a bail 76 is captured. The opposite end of the bail is pivotally mounted at 78 on the connecter 38. Accordingly, when a short circuit occurs the armature 56 moves against the trip lever 62 to move the contacts 16 to the open position (FIG. 2), the lower portion of the lever 62 rotates away from the inclined surface 72. Simultaneously, the movable contacts 16, 16a (FIG. 7), which are pivotally mounted at 80 on arc guide rails 82, 82*a*, together with a guide bail 84, (attached to the lower end of the contacts) compress a spring 86 to rotate the tilt lever 64 in a clockwise direction. As a result the bail 76 slides down over the inclined surface 72, so that the tilt lever applies no force against the connector 38.

Figure 4:
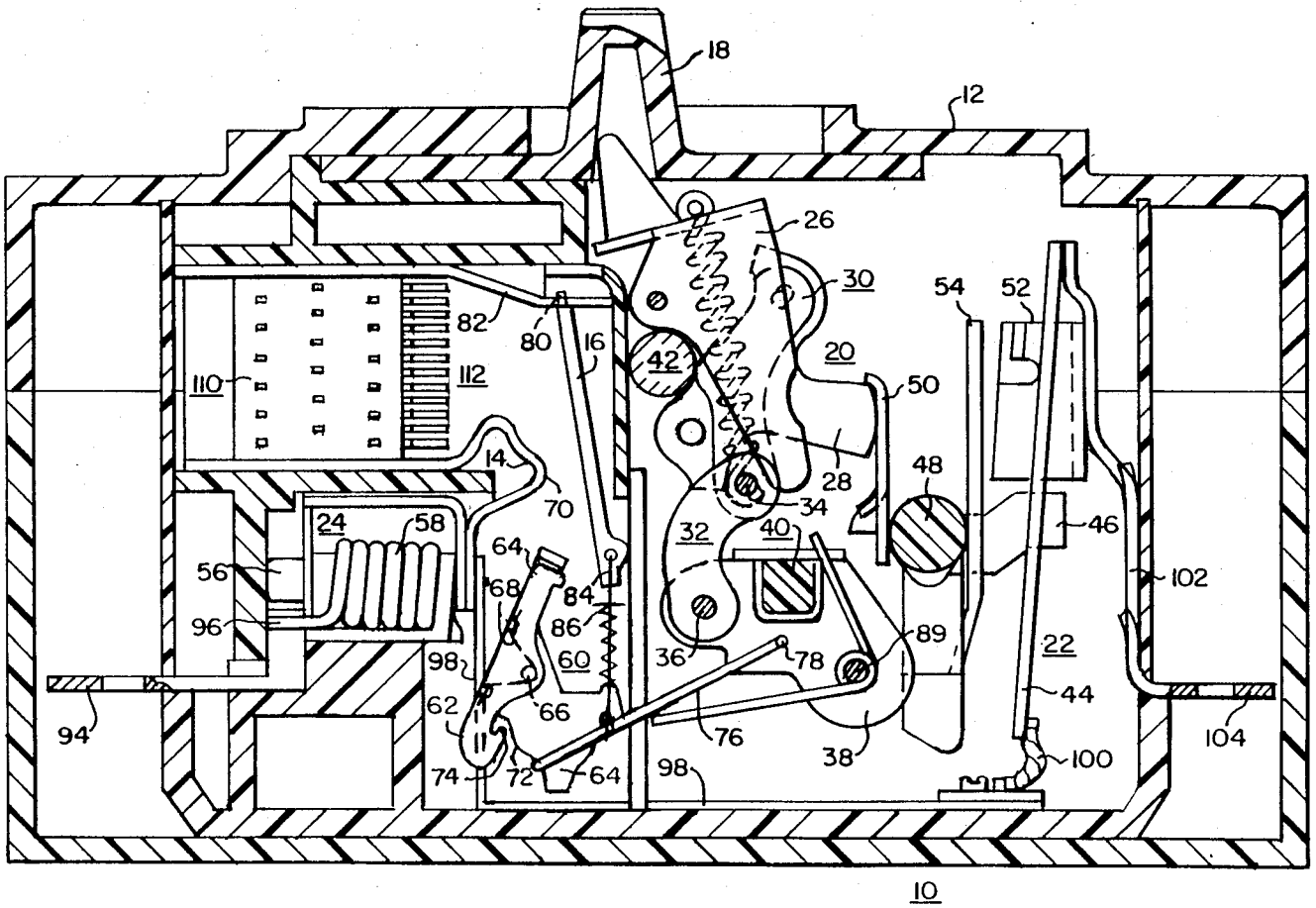
FIG. 4 is a sectional view showing the contacts open when opened by the operating lever.

As the movable contact 16 moves through toggle it stops at a fully open position (FIG. 4) and the trip lever 62 and tilt lever 64 are aligned. The spring 86, having expanded again after going over toggle, has rotated the tilt lever clockwise about the pivot 66 and the bail 76 is retained against the inclined surface 72 by the spring 88.

Figure 5:
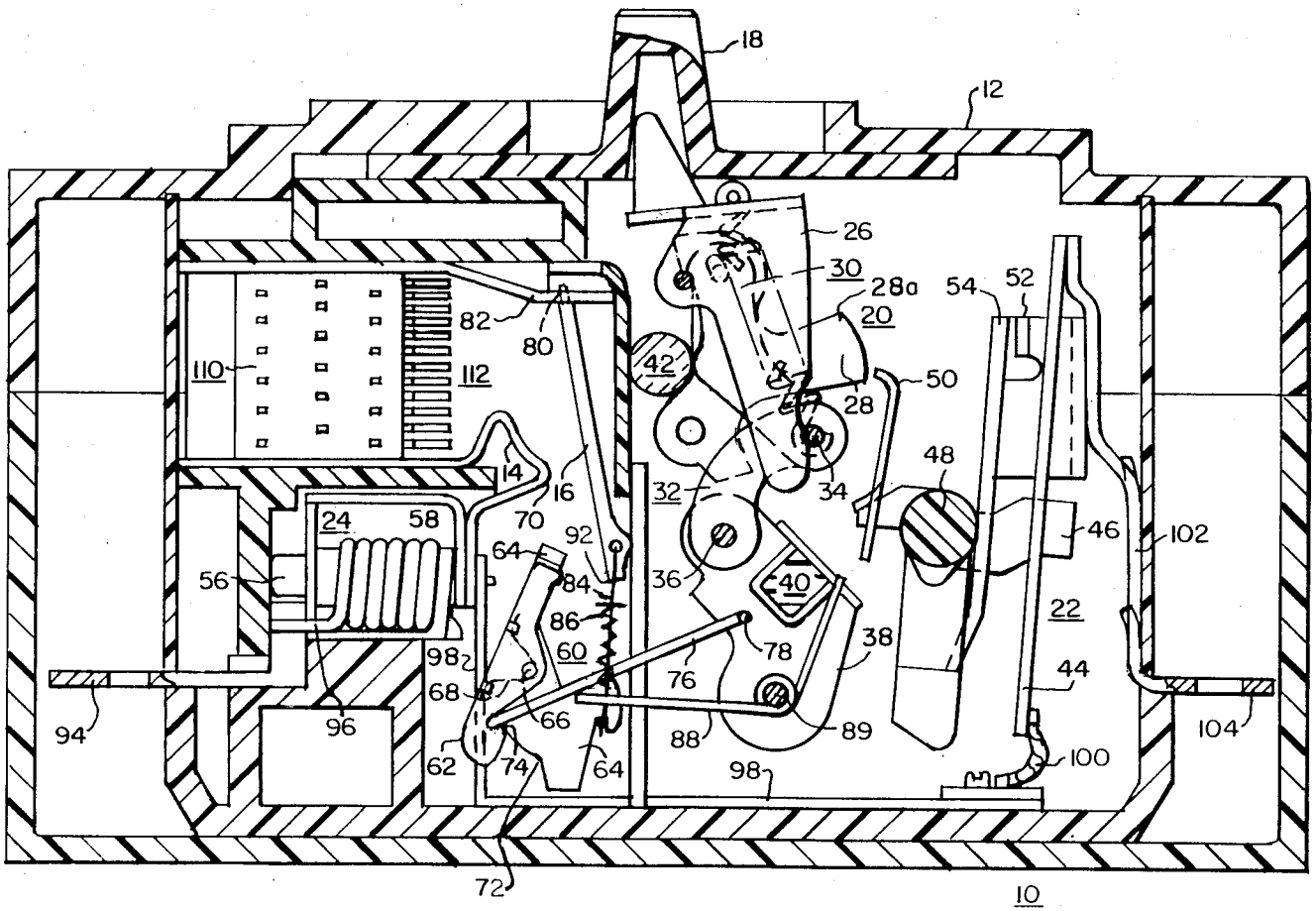
FIG. 5 is a sectional view showing the circuit breaker in the trip position.

When the breaker is tripped, the operating mechanism 20 is in the position shown in FIG. 5 with the latch 50 unlatched from surface 28*a*. The connector 38, having been rotated about the tie bar 40, applies added pressure to the wire spring 88 which moves the bail 76 up the inclined surface 72 and is recaptured in the notch 74.

Figure 6:
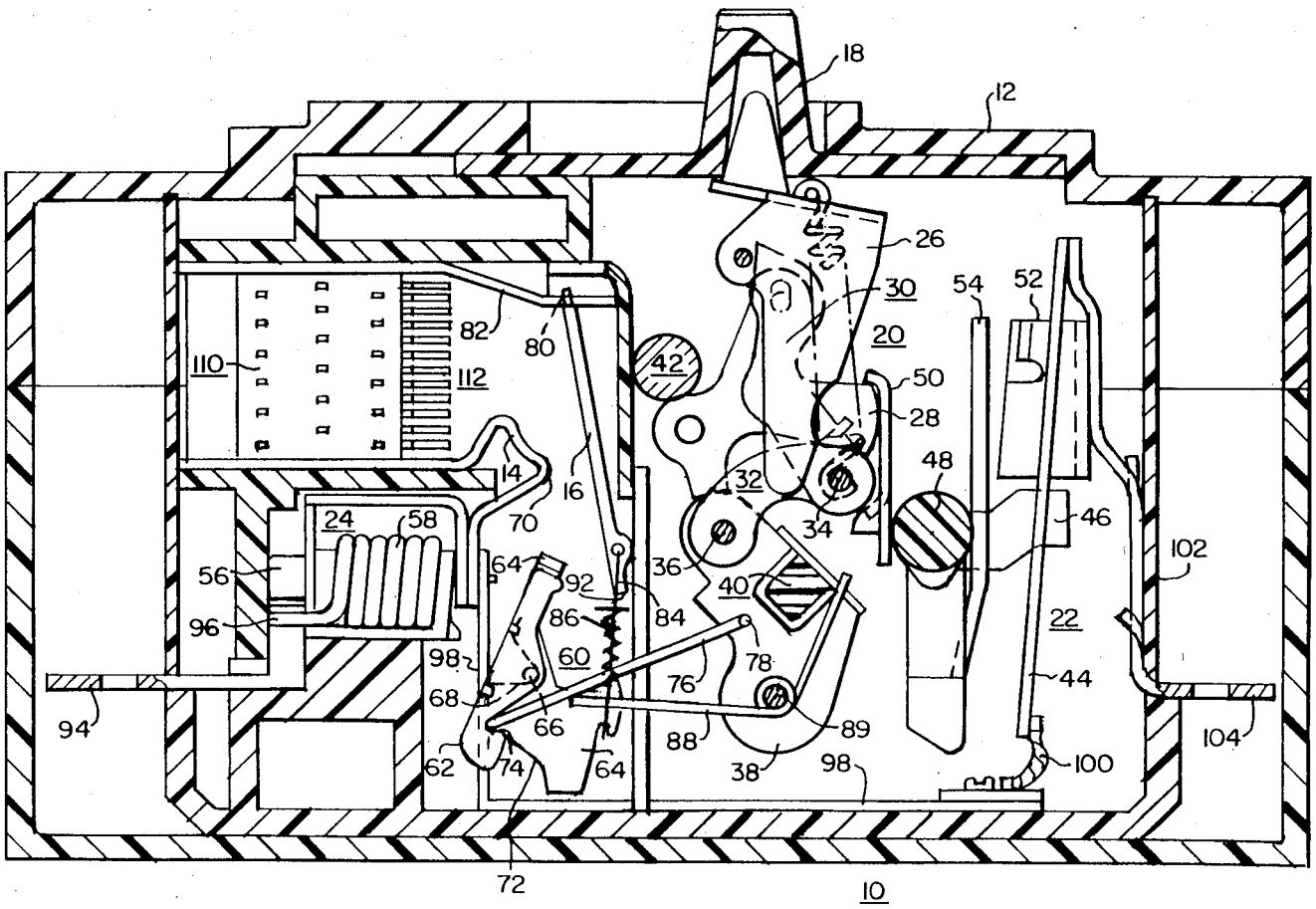
FIG. 6 is a sectional view showing the circuit breaker in the "off" or reset position.

To restore the closed circuit condition of the contacts, the handle 18 is moved to the right to a normally OFF, or reset, position of the contacts (FIG. 6), and then the handle 18 is again moved to the left to the ON position which movement rotates the connector 38 counterclockwise and through the bail 76, causing rotation of the tilt lever 64 so that the compression spring 86 moves the contacts 16 into the closed condition (FIG. 1).

In accordance with this invention the structure of the stationary and movable contacts is shown in FIG. 7. The stationary contact 14 is comprised of the pair of contacts 14 and 14*a*. The movable contacts 16 includes the pair of contacts 16 and 16*a*, the lower portions of which are interconnected by a bight portion 90 having a tab 92 extending therefrom. When the armature 56 is actuated, it pushes the trip lever 62 against the tab 92 for opening the contacts.

When the contacts are closed, a circuit through the circuit breaker 10 extends from a line terminal 94 through a conductor 96, the coil 58, the contacts 14, 16, bight portion 90, contacts 16*a*, 14*a* to a conductor 98, a shunt 100, the bimetal strip 44, and a conductor 102 to a load terminal 104. When the contacts are opened, any arc 106 (FIG. 2) moves from the similar knees 70 of the contacts 14, 14*a* upwardly between the stationary and movable contacts to positions between the arc guide rails 82, 82*a* and rails 108 and 108*a*. As shown, the guide rails 82, 108 are disposed along the top and bottom of an arc chute 110 for extinguishing any arc occurring between the separating contacts, Similarly, any arc forming between the separating contacts 14*a*, 16*a* moves from the contacts to the arc guide rails 82*a*, 108*a* (FIG. 7) into an arc chute 110*a*. Thus, each pole of the circuit breaker 10, of which only one pole has been disclosed herein, includes a pair of double break contacts per pole with two arc chutes located side-by-side. An insulating wall 112 is disposed between the arc chutes 110, 110*a*. Thus, a series of double break contacts per pole develop a high arc voltage comparable to or higher than the circuit so as to achieve current limiting characteristics and to reduce the peak fault currents and the thermal energy.

Figure 8:
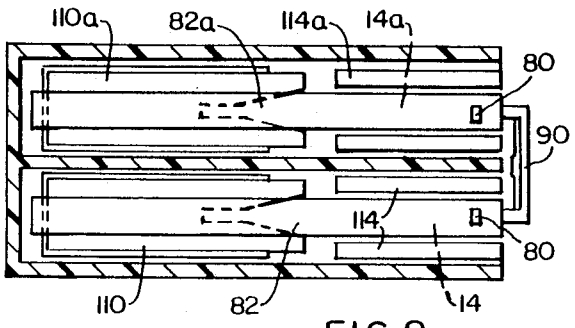
FIG. 8 is a horizontal sectional view taken on the line VIII—VIII of FIG. 1.

To enhance the initial arc motion from the stationary contacts 14, 14*a* and the movable contacts 16, 16*a* additional insulation is preferably provided on opposite sides of the corresponding contacts 14 and 16, and 14*a* and 16*a* (FIG. 8) by providing plates 114, 116, 114*a*, 116*a*. The plates are comprised of electrically insulating material, such as ceramic.

In conclusion, the current limiting circuit breaker of this invention provides a series double break contact system per pole with active arc runners which extend into side-by-side arc chambers with an arc chute in each side. The current limiting mechanism includes a solenoid plunger trip unit in conjunction with manual operation through a standard breaker mechanism, an automatic reset is included on the current limiting mechanism upon opening of the standard breaker mechanism.

What is claimed is:

1. A current limiting circuit breaker comprising:

an electrically insulating housing and including line and load terminals;

a circuit breaker structure within the housing and having stationary contact means and movable contact means;

arc-quenching means including at least two separate arc-quenching chambers within the housing and having a line side arc guide rail and a load side arc guide rail;

the stationary contact means including at least a pair of spaced stationary contacts, one contact on the line side and adjacent to one of the chambers and the other contact being on the load side and adjacent to the other of the chambers;

the movable contact means including at least a pair of corresponding movable contacts connected in series and movable simultaneously between open and closed circuit conditions;

first means for actuating the movable contacts between open and closed circuit conditions;

second means for moving the movable contacts and including current limiting electromagnetic means responsive to an overcurrent circuit condition; and each movable contact being an elongated arm having one end pivotally mounted on a corresponding arc guide rail and another end in response to operation of one of the first and second means, so as to cause arcs forming between the corresponding stationary and movable contacts to move from the contacts and between the rails of corresponding arc-quenching chambers.

2. The current limiting circuit breaker of claim 1 in which the arc-quenching means are disposed in side-by-side relationship.

3. The current limiting circuit breaker of claim 2 in which the first movable contact means comprises a manually operable overcenter toggle mechanism.

4. The circuit breaker of claim 3 in which linkage means are disposed between the movable contacts and the overcenter toggle mechanism for opening the contacts without actuating said mechanism and for enabling closing of the movable contacts after said mechanism is tripped and reset.

5. The current limiting circuit breaker of claim 3 in which the second means includes lever means removable to trip the movable contact arm to open circuit condition in response to actuation of the electromagnetic means.

6. The current limiting circuit breaker of claim 5 in which a connecting link extends between said mechanism and the lever means, and first spring bias means for disengaging the link from the lever means when trip action is initiated by the electromagnetic means to disengage the lever means from said mechanism.

7. The current limiting circuit breaker of claim 6 in which second bias means are provided for retaining the link in engagement with the lever means when trip action is initiated by the manually movable overcenter toggle mechanism.

8. The current limiting circuit breaker of claim 7 in which third spring means are disposed between the lever mean and the movable contact means for retaining the lever means in a position corresponding to the open circuit position and for moving the movable contact means to the closed circuit position when said mechanism is moved to the closed circuit position.

* * * * *